United States Patent [19]

Kadykowski

[11] 4,330,966

[45] May 25, 1982

[54] GROOVE GRINDING FIXTURE

[75] Inventor: Frank Kadykowski, Sterling Heights, Mich.

[73] Assignee: Dana Corporation, Toledo, Ohio

[21] Appl. No.: 179,208

[22] Filed: Aug. 18, 1980

[51] Int. Cl.[3] ..... B24B 47/02

[52] U.S. Cl. ..... 51/230; 51/97 NC; 51/216 ND; 82/18

[58] Field of Search ..... 51/216 ND, 230, 97 NC; 82/18, 19

[56] References Cited

U.S. PATENT DOCUMENTS

| | | | |
|---|---|---|---|
| 1,687,143 | 10/1928 | Richard | 82/18 |
| 3,813,969 | 6/1974 | Wheeler | 82/19 |
| 3,877,179 | 4/1975 | Hammann | 51/165.71 |
| 3,934,378 | 1/1976 | Ditzel | 51/216 ND |
| 4,210,039 | 1/1980 | Willemin | 82/18 |

FOREIGN PATENT DOCUMENTS

| | | | |
|---|---|---|---|
| 507833 | 6/1939 | United Kingdom | 82/18 |

*Primary Examiner*—Harold D. Whitehead
*Attorney, Agent, or Firm*—Frank B. McDonald

[57] ABSTRACT

A grinding fixture provides for grinding a pair of oppositely positioned complementary ball engaging meridian race grooves in the external surface of the inner race member of a constant velocity universal joint, wherein the race grooves are characterized by offset centers. The fixture, adapted to receive and contain the inner race member for grinding, is engageable with, and rotatable between, headstock and tailstock members of a grinding machine. In a preferred embodiment, the fixture incorporates a slide assembly which is reciprocated between two offset parallel centerlines during grinding of a race member contained within the fixture.

12 Claims, 5 Drawing Figures

GROOVE GRINDING FIXTURE

BACKGROUND

This invention relates to constant velocity universal joints of the type comprising spherically engaging inner and outer members, coupled together by a plurality of balls which engage arcuate meridian race grooves in the members. More particularly, this invention relates to apparatus adapted for grinding the race grooves of the spherically shaped inner member, which is often referred to as the inner race of a constant velocity universal joint of the Rzeppa type, as well known in this art. In the standard Rzeppa joint, adjacent meridian race grooves are ground about a common point, or center.

It has been determined that offsetting the centers of adjacent inner race grooves balances end thrust, and thus provides for enhanced high speed performance over the standard Rzeppa type universal joint. Thus, in U.S. Pat. No. 2,875,600, Miller discloses a pair of alternate offset centers about which the meridian race grooves of an inner race are ground.

A significant disadvantage has been realized, however, in the manufacture of Miller's inner race member. Machining alternate offset grooves has required grinding each groove about the spherical surface of the inner race on a one-at-a-time basis. This has been due to the Rzeppa joint's inherent possession of an even number (generally six) of equally spaced meridian race grooves, each groove having an opposing counterpart groove spaced exactly 180° therefrom. The offset center geometry results in all such opposing pairs of grooves having to necessarily be ground about offset centers.

As fixtures employed in the grinding of standard Rzeppa type inner race grooves grind pairs of oppositely positioned grooves in a single cutting operation, the principal drawback of prior art devices for grinding alternate offset grooves is thus the lack of speed realized by virtue of the limitation of grinding only one groove at a time.

SUMMARY OF INVENTION

The invention disclosed herein provides an apparatus for grinding alternate offset meridian ball race grooves in a modified Rzeppa universal joint inner race in pairs; thus, without compromise in grinding speed otherwise resulting from the grinding of offset opposing ball meridian races singularly therein. The invention therefore provides a means whereby oppositely positioned ball race grooves located on offset centers may be ground in pairs. In a preferred embodiment, a grinding fixture, having a workpiece holder for receiving and containing an inner race to be ground, is engageable with and rotatable between headstock and tailstock members of a grinding machine. The fixture includes a headstock adaptor which houses a slide assembly for reciprocating the workpiece holder between two limits of movement during rotation of the holder. Thus provided is a rotary movement of the holder about offset centers, whereby the opposing grooves of a modified Rzeppa inner race may be ground in pairs, and thus without the compromises of the prior art.

DESCRIPTION OF PREFERRED EMBODIMENTS

Figure 1:
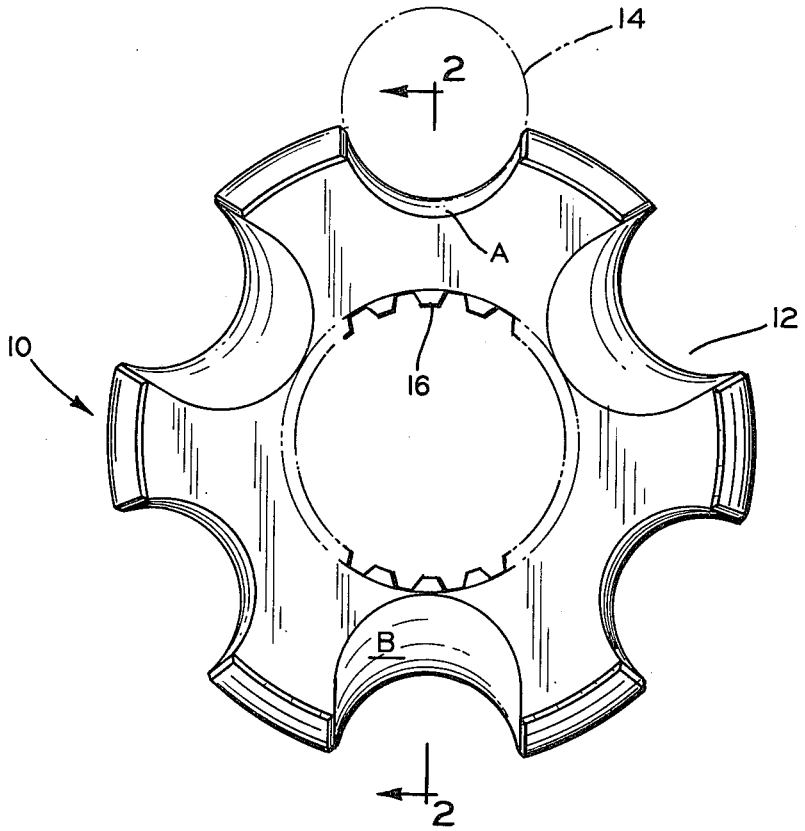
FIG. 1 is a face view of a spherically shaped inner race of a Rzeppa type constant velocity universal joint having alternately offset ball bearing meridian race grooves.
Figure 2:
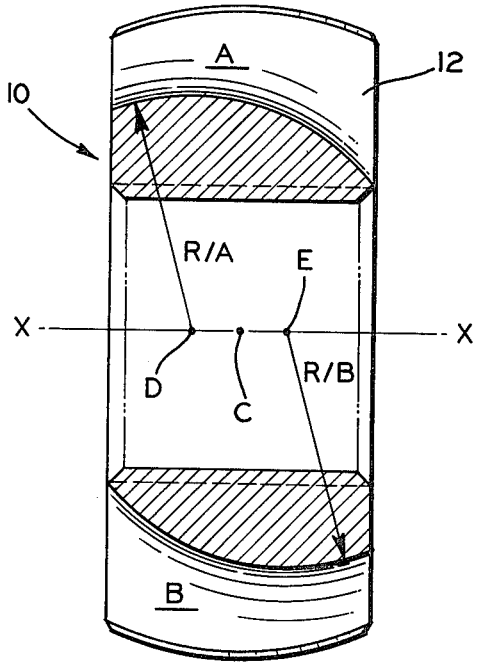
FIG. 2 is a cross-sectional side view of the inner race of FIG. 1, taken along lines 2—2 of FIG. 1.

FIGS. 1 and 2 depict an inner race 10 of the Rzeppa type universal joint, incorporating alternately angularly offset ball race meridian grooves 12. In the Rzeppa constant velocity universal joint, there is a ball 14 for each groove 12, the balls 14 rotating in a plane which always bisects the angle between axes of the inner race 10 (inner member) and an outer member, not shown, regardless of the working angle of the two members. Also in the latter type of joint, the inner race 10 is typically the driven member, and is generally splined to a drive shaft, not shown, via splines 16 (FIG. 1). FIG. 2 is a cross-sectional side view of the inner race 10 of FIG. 1, which shows the offset centers of oppositely positioned (180 degrees apart) meridian grooves A and B of FIG. 1. Referring to FIG. 2, the inner race 10 (inner member) moves relatively to an outer member about point C. The grooves A and B of inner member 10 are ground about equally offset centers D and E, respectively, the latter centers being oppositely equidistant from point C along the axis X—X of the inner member 10. Thus, groove A is ground along radius R/A, while groove B is ground along radius R/B.

Figure 3:
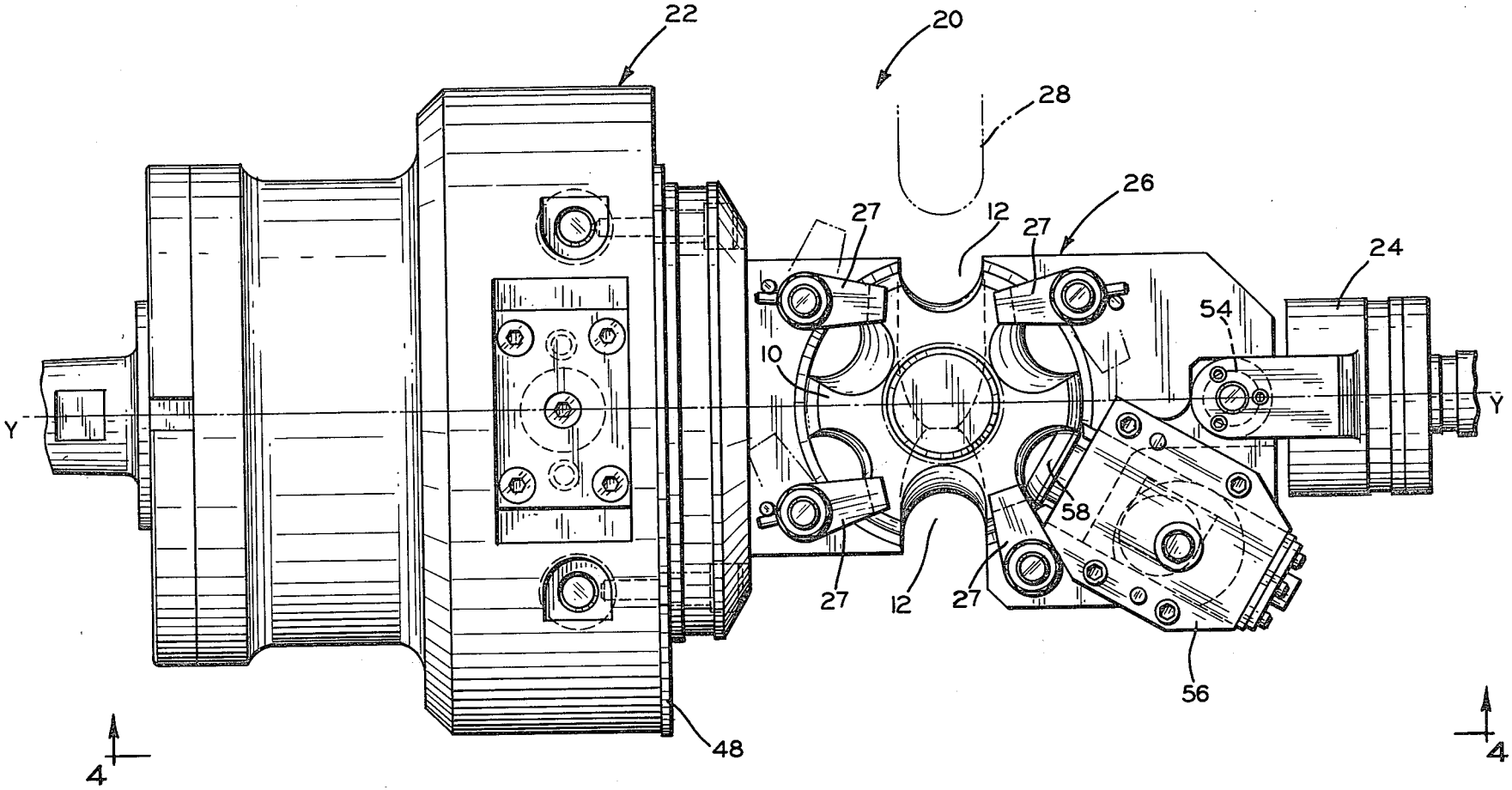
FIG. 3 is a plan view of a preferred embodiment of the fixture of this invention utilized for grinding inner races of the alternate offset (modified) Rzeppa type.

FIG. 3 is a plan view of preferred apparatus for grinding the complementary opposing grooves A and B of FIGS. 1 and 2. Thus, a fixture 20 is engageable with and rotatable between headstock and tailstock members of a grinding machine, not shown.

The fixture 20 includes a headstock adaptor 22, a tailstock adaptor 24, and a workpiece holder 26 affixed to, and positioned intermediate, the latter adaptors. As shown in both FIGS. 3 and 4, the workpiece holder 26 receives and contains, via bolted hold-down tabs 27, an inner race 10 for grinding of grooves 12 therein. The fixture 20 is rotated, via conventional electric powered rotary headstock, not shown, about axis Y—Y, and as the fixture 20 rotates, a rotating grinding wheel 28 (FIG. 3) is advanced toward the workpiece holder 26 for grinding grooves 12 in the workpiece (an inner race 10) contained therein.

Figure 4:
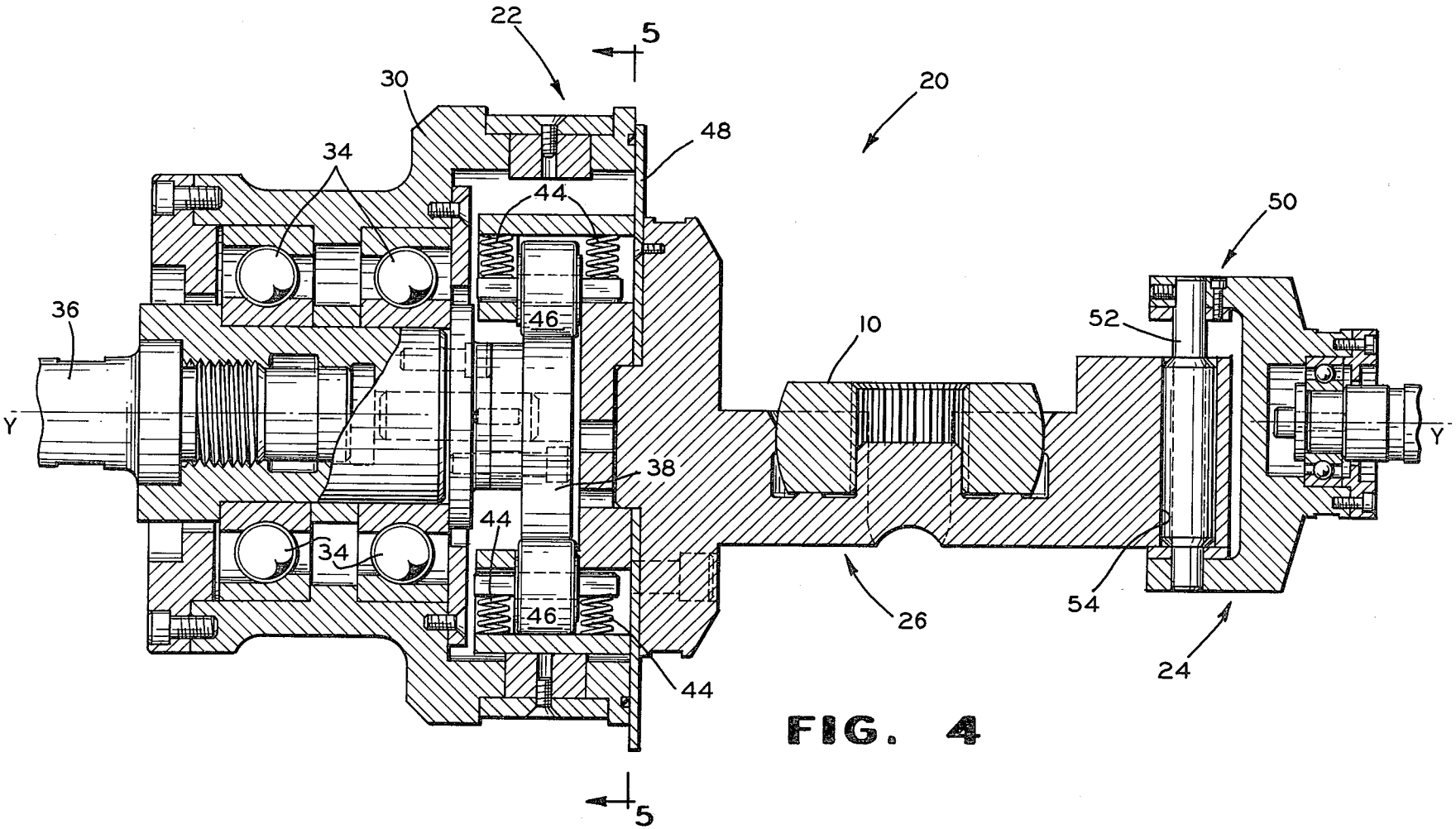
FIG. 4 is an elevation in cross-section of the fixture of FIG. 3, taken along lines 4—4 of FIG. 3.

Referring now specifically to FIG. 4, the headstock adaptor 22 of the preferred embodiment shown and described herein includes an external rotary casing 30 which is bolted to a flange (not shown) on the aforementioned electric powered rotary headstock. The casing 30 is rotated thereby on bearings 34 about a non-rotary headstock adaptor shaft 36. In the preferred embodiment, the shaft 36 extends from the back of the headstock 22 and is grounded to the frame thereof, not shown. Fixed to the latter non-rotary shaft 36 is a cam 38, housed internally of the headstock adaptor 22.

Figure 5:
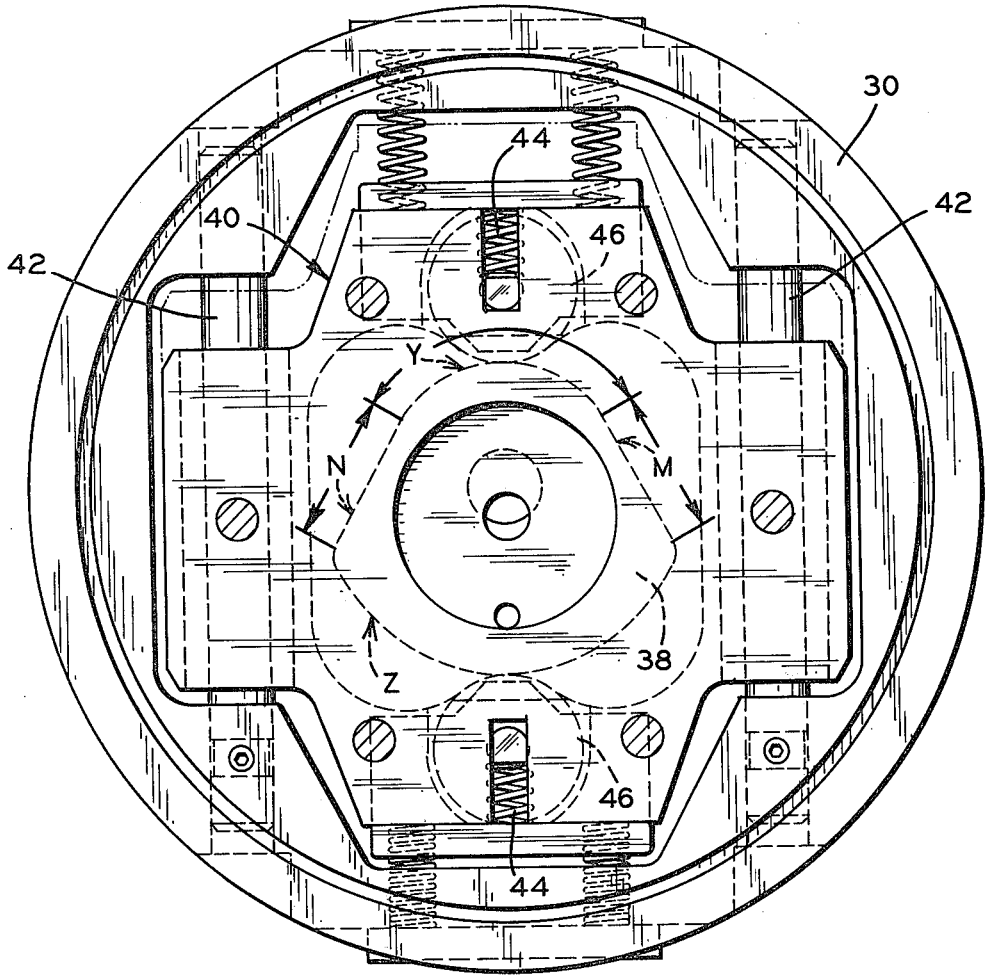
FIG. 5 is a cross-sectional view of the slide assembly of the fixture of FIGS. 3 and 4, taken along lines 5—5 of FIG. 4.

Referring to FIG. 5, which more clearly shows a concentric relationship between the fixed cam 38 and rotary casing 30, it will be seen that concentrically intermediate the cam and casing is a primary slide assembly 40 which moves in a reciprocal motion along primary guides 42, which are rigidly affixed to the rotary casing 30. Thus, as the casing 30 rotates, the slide assembly 40 is forced to rotate therewith. Affixed to the slide assembly 40 by spring loaded mounts 44 are cam followers 46, which roll along the edge of cam 38 as shown, and impart reciprocal motion to the slide assembly 40. An external shuttle 48 (FIG. 4) is affixed to the primary slide assembly 40. The workpiece holder 26 is in turn rigidly affixed to the external shuttle 48. Thus, as the slide assembly 40 is forced to rotate via the rotary casing 30 via guides 42, and to reciprocate between two end limits via cam 38, the assembly 40 will impart a wobbling or assymetrical rotation to the workpiece holder 26, thus enabling the aforesaid paired grinding of opposing grooves A and B (FIGS. 1 and 2) on separate centers. The cam 38, as shown in FIG. 5, has two flat portions M and N, which, via rolling contact thereof with cam followers 46, effectuate the back and forth shuttling of grinding centers D and E (FIG. 2) within the grinding plane. On the other hand, grooves A and B (FIGS. 1 and 2) are ground on offset centers during rolling contact of the followers 46 along the respective arcuate portions Y and Z of the cam 38.

Referring back to FIGS. 3 and 4, the tailstock adaptor 24 merely provides a following connection to the opposite end of the workpiece holder 26. Thus, the adaptor 24 rotates with the workpiece holder, but does not move reciprocally as does the holder. Instead, the adaptor incorporates a follower slide assembly 50 which accomodates the reciprocal motion of the holder via a follower guide 52, which extends through a bore 54 in the follower end of the workpiece holder 26.

A preferred method of grinding alternately offset meridian race grooves may now be described as follows. As grinding is generally a finishing operation, it is normally employed in the achievement of final dimension tolerances. Thus, in a preferred embodiment of the apparatus as described herein, the alternately offset grooves will have already been milled into inner races 10 which are then ready for grinding. A milled inner race 10 is thus inserted into the workpiece holder 26 and is clamped thereto by the hold-down tabs 27. A sliding locator 56 (FIG. 3) is then positioned against one of the milled grooves 12 of race 10 for securement thereof into a position for achieving final dimensional tolerance. The locator 56 includes a race engaging member 58 which ensures proper grinding position of the milled race 10 in the workpiece holder. The workpiece holder 26 is axially rotated in the aforedescribed fixture 20, which includes the cam 38 for imparting reciprocal motion between offset centers as heretofore described. During rotation of fixture 20, the grinding wheel 28 is radially advanced toward the workpiece holder, thus contacting the milled inner race 10 in a manner as to ground the oppositely positioned race grooves contained therein on offset centers.

After the first pair of corresponding race grooves are ground, the locator 56 is retracted, and the milled race 10 is indexed for grinding the next adjacent pair of grooves. The locator 56 is then re-engaged against the workpiece, and the process is repeated until all inner race grooves are ground.

What is claimed is:

1. In a fixture for grinding pairs of oppositely positioned complementary grooves in a workpiece; an improvement comprising means to rotate said fixture for grinding said oppositely positioned grooves on offset centers in a single operation; said means defining a fixed cam comprising two flat portions thereon, said flat portions imparting a reciprocal motion to said fixture during the rotation of said fixture, whereby said workpiece rotates between two distinct centers of rotation.

2. The fixture of claim 1 wherein said workpiece comprises an inner race member of a constant velocity universal joint, and wherein said oppositely positioned complementary grooves are ball engaging arcuate meridian races in the external surface of said inner race member.

3. The fixture of claim 2 further being engageable with and rotatable between headstock and tailstock members of a grinding machine.

4. The grinding fixture of claim 3 wherein said means to rotate said fixture for grinding of oppositely positioned race grooves comprises a headstock adaptor containing a primary slide assembly, a tailstock adaptor containing a follower slide assembly, and a workpiece holder affixed to, and positioned intermediate, said adaptors.

5. The grinding fixture of claim 4 wherein said headstock adaptor comprises means for reciprocating said primary slide assembly between two end limits, as said headstock adaptor is rotated.

6. The grinding fixture of claim 5 wherein said primary slide assembly of said headstock adaptor is rotated about offset centers, and imparts like motion to said workpiece holder affixed thereto.

7. The grinding fixture of claim 6 wherein said means in said headstock adaptor for reciprocating said primary slide assembly comprises said cam.

8. The grinding fixture of claim 7 wherein said cam is fixed to one end of a non-rotary headstock adaptor shaft, said cam and shaft positioned internally of, and concentric with, said headstock adaptor.

9. The grinding fixture of claim 8 wherein an external rotary member of said headstock adaptor is rotatable by a headstock member of a grinding machine about bearings positioned intermediate said rotary member and said non-rotary headstock adaptor shaft, said rotary member including guides fixed thereto and permitting only reciprocal motion of said primary slide assembly relative thereto, as said rotary member is rotated about said adaptor shaft and cam via said headstock member.

10. The grinding fixture of claim 9 wherein said primary slide assembly further comprises an external shuttle member, said shuttle member affixed to said workpiece holder, whereby, as said primary slide assembly is rotated about said cam and is thereby reciprocated along said guides, said external shuttle member transmits the motion of said primary slide assembly to said workpiece holder.

11. The grinding fixture of claim 10 wherein said workpiece holder is disposed for the containment of an inner race of a universal joint for grinding thereof, and whereby locator means hold said joint fixed in said workpiece holder during said grinding thereof.

12. The grinding fixture of claim 11 wherein said locator means further comprise slidably engaging, race contacting member disposed for fixing an inner race in an indexed positioned for said grinding thereof.

* * * * *